US010568384B2

(12) United States Patent
Glaze et al.

(10) Patent No.: US 10,568,384 B2
(45) Date of Patent: Feb. 25, 2020

(54) SOLE INSERT WITH MATING ATTACHMENT SYSTEM

(71) Applicants: Tammy Terrell Glaze, Simpsonville, SC (US); Horace Dean Glaze, Simpsonville, SC (US)

(72) Inventors: Tammy Terrell Glaze, Simpsonville, SC (US); Horace Dean Glaze, Simpsonville, SC (US)

( * ) Notice: Subject to any disclaimer, the term of this patent is extended or adjusted under 35 U.S.C. 154(b) by 0 days.

(21) Appl. No.: 15/785,616

(22) Filed: Oct. 17, 2017

(65) Prior Publication Data

US 2018/0116338 A1 May 3, 2018

Related U.S. Application Data

(60) Provisional application No. 62/414,006, filed on Oct. 28, 2016.

(51) Int. Cl.
*A43B 17/18* (2006.01)
*A43B 17/02* (2006.01)
(Continued)

(52) U.S. Cl.
CPC ..... *A43B 17/18* (2013.01); *A43B 3/0047* (2013.01); *A43B 3/10* (2013.01); *A43B 3/12* (2013.01); *A43B 3/18* (2013.01); *A43B 3/246* (2013.01); *A43B 7/142* (2013.01); *A43B 7/144* (2013.01); *A43B 7/148* (2013.01); *A43B 7/1445* (2013.01); *A43B 7/1465* (2013.01); *A43B 7/1485* (2013.01); *A43B 13/12* (2013.01); *A43B 13/188* (2013.01); *A43B 13/28* (2013.01); *A43B 13/36* (2013.01); *A43B 13/386* (2013.01);
(Continued)

(58) Field of Classification Search
CPC ..... A43B 17/00; A43B 17/18; A43B 17/006; A43B 17/026; A43B 17/14; A43B 17/105; A43B 7/142; A43B 7/144; A43B 7/1445; A43B 7/1465; A43B 7/148; A43B 7/1485; A43B 3/0047; A43B 3/246; A43B 3/18; A43B 13/28; A43B 13/36; A43B 13/386; A43B 13/12; A43B 13/188
USPC ..... 36/43, 11.5
See application file for complete search history.

(56) References Cited

U.S. PATENT DOCUMENTS 1,523,956 A * 1/1925 Grosjean ..... A43B 13/12 36/59 B
1,524,997 A * 2/1925 Potter ..... A43B 13/24 36/59 B
(Continued)

FOREIGN PATENT DOCUMENTS

DE 202005011497 U1 10/2005
GB 2309625 A1 8/1997
(Continued)

OTHER PUBLICATIONS

ECCO, http://www.eccoshoesuk.com/ecco-cut-to-size-leather-insoles/p49.
(Continued)

*Primary Examiner* — Alissa J Tompkins
*Assistant Examiner* — Dakota Marin
(74) *Attorney, Agent, or Firm* — Burr & Forman LLP; Douglas L. Lineberry

(57) ABSTRACT

An insole for open-styled footwear that includes a mating attachment system for variably affixing the insole into footwear.

15 Claims, 8 Drawing Sheets

(51) Int. Cl.

| | |
|---|---|
| ***A43B 17/14*** | (2006.01) |
| ***A43B 7/14*** | (2006.01) |
| ***A43B 17/00*** | (2006.01) |
| ***A43B 13/36*** | (2006.01) |
| ***A43B 3/00*** | (2006.01) |
| ***A43B 3/24*** | (2006.01) |
| ***A43B 13/18*** | (2006.01) |
| ***A43B 3/18*** | (2006.01) |
| ***A43B 13/38*** | (2006.01) |
| ***A43B 13/12*** | (2006.01) |
| ***A43B 13/28*** | (2006.01) |
| ***A43B 3/10*** | (2006.01) |
| ***A43B 3/12*** | (2006.01) |
| ***A43B 17/10*** | (2006.01) |

(52) U.S. Cl.

CPC ..... *A43B 17/00* (2013.01); *A43B 17/006* (2013.01); *A43B 17/026* (2013.01); *A43B 17/105* (2013.01); *A43B 17/14* (2013.01)

(56) References Cited

U.S. PATENT DOCUMENTS 1,596,925 A * 8/1926 Falcone ..... A43B 7/1465 36/157
1,693,122 A 11/1928 Schwartz
1,702,531 A * 2/1929 Ambill ..... A43B 1/0045 36/146
1,777,855 A 10/1930 Oblak
1,780,574 A 11/1930 Williams
1,890,383 A * 12/1932 Howell ..... A43B 7/1465 36/157
1,920,112 A * 7/1933 Shaft ..... A43B 21/32 36/28
2,121,176 A 6/1938 Shain
2,138,227 A 11/1938 Damon
2,181,522 A * 11/1939 Lazarus ..... A43B 7/1415 36/146
2,426,735 A * 9/1947 Hiss ..... A43B 7/141 36/146
2,441,891 A * 5/1948 Lucey ..... A43B 7/142 12/142 N
2,865,097 A * 12/1958 Vollrath, Jr. ..... A43B 17/18 12/142 R
3,027,661 A * 4/1962 Mccord ..... A43B 13/24 36/103
3,257,742 A 6/1966 Feinberg
3,417,494 A 12/1968 Claff
3,672,077 A * 6/1972 Coles ..... A43B 5/00 12/142 P
3,890,725 A * 6/1975 Lea ..... A43B 3/24 36/11.5
4,030,212 A * 6/1977 Ito ..... A43B 3/106 36/11.5
4,124,946 A 11/1978 Tomlin
4,387,516 A * 6/1983 Laux ..... A43B 3/0078 36/43
4,420,894 A * 12/1983 Glassman ..... A43B 13/28 36/107
4,991,317 A * 2/1991 Lakic ..... A41D 19/001 36/29
1,144,291 A 6/1991 Boyer
5,025,573 A 6/1991 Giese
D324,761 S 3/1992 Soo-Kwan
D329,129 S 9/1992 Brown
5,737,857 A * 4/1998 Aumann ..... A43B 7/125 36/55
5,761,833 A * 6/1998 McMullin ..... A43B 5/001 36/134
5,996,254 A 12/1999 Goven
D423,766 S 5/2000 Genga
D432,769 S 10/2000 Yung
6,176,025 B1 1/2001 Patterson
6,243,973 B1 * 6/2001 Lind ..... A43B 13/26 36/100
D446,637 S 8/2001 Patterson
6,311,415 B1 * 11/2001 Lind ..... A43B 5/00 36/130
6,442,870 B1 * 9/2002 Tsai ..... A43B 3/103 36/100
D487,185 S 3/2004 Grisoni
6,792,697 B2 * 9/2004 Wright ..... A43B 1/10 12/142 S
D518,945 S 4/2006 Vasyli
D532,586 S 11/2006 Birkenstock
7,140,130 B2 11/2006 Brooks
7,152,340 B2 * 12/2006 Issler ..... A43B 1/0081 36/15
7,284,342 B2 10/2007 Avent et al.
D556,990 S 12/2007 Cabados
7,353,770 B2 4/2008 Sanguinetti
D572,888 S 7/2008 Cai
7,406,781 B2 * 8/2008 Scholz ..... A43B 3/24 36/134
D578,284 S 10/2008 Elliott
7,721,466 B2 * 5/2010 Guo ..... A43B 13/36 36/15
D618,896 S 7/2010 Elliott
7,823,297 B2 * 11/2010 Moretti ..... A43B 7/125 36/12
D632,468 S 2/2011 Meador
D681,321 S 5/2013 Martinez
8,458,927 B2 * 6/2013 Santos ..... A43B 13/36 36/100
D721,880 S 2/2015 Finn
D722,754 S 2/2015 Vasyli
D722,755 S 2/2015 Vasyli
D729,509 S 5/2015 Lee
9,192,208 B2 * 11/2015 Peikert ..... A43B 1/04
D746,033 S 12/2015 Cherneski
9,277,784 B1 * 3/2016 Lawson ..... A43B 13/38
D753,908 S 4/2016 Vasyli
D762,053 S 7/2016 Takahashi
D771,363 S 11/2016 Vasyli
D796,175 S 9/2017 Mitchell
2002/0092203 A1 7/2002 Hardt
2002/0112372 A1 * 8/2002 Coomes ..... A43B 3/0078 36/11.5
2002/0157278 A1 * 10/2002 Moretti ..... A43B 7/06 36/3 R
2002/0174569 A1 * 11/2002 Tsai ..... A43B 3/103 36/101
2003/0024134 A1 2/2003 Howlett
2004/0055179 A1 * 3/2004 Wang ..... A43B 3/103 36/11.5
2004/0111924 A1 * 6/2004 Riccardi ..... A43B 7/146 36/141
2004/0118017 A1 6/2004 Dalton
2004/0230146 A1 * 11/2004 Chang ..... A43B 7/1465 601/134
2005/0034332 A1 * 2/2005 Moschel ..... A43B 3/103 36/101
2005/0120591 A1 6/2005 Andrew
2005/0236784 A1 * 10/2005 Zampieri ..... A43B 5/1641 280/11.27
2006/0026862 A1 * 2/2006 Cagner ..... A43B 3/103 36/11.5
2006/0026865 A1 2/2006 Grisoni et al.
2006/0059726 A1 * 3/2006 Song ..... A43B 7/142 36/142
2007/0074334 A1 * 4/2007 Steel ..... A41B 11/004 2/239
2007/0079532 A1 * 4/2007 Ramirez ..... A43B 7/1415 36/140
2007/0271815 A1 * 11/2007 Moretti ..... A43B 7/08 36/3 B
2008/0000105 A1 * 1/2008 Cotton ..... A43B 3/106 36/83

(56) References Cited

U.S. PATENT DOCUMENTS

2008/0092406 A1* 4/2008 Ludemann ..... A43B 17/18 36/43
2008/0216358 A1* 9/2008 Moretti ..... A43B 7/08 36/3 A
2008/0271340 A1 11/2008 Grisoni
2009/0044424 A1* 2/2009 Kohler ..... A43B 7/00 36/44
2009/0188134 A1* 7/2009 Moretti ..... A43B 7/125 36/3 B
2009/0199438 A1* 8/2009 Moretti ..... A43B 7/125 36/3 B
2010/0018074 A1 1/2010 Greene
2010/0031532 A1 2/2010 Bass
2010/0058540 A1* 3/2010 Calvert ..... A43B 1/0081 5/652
2010/0115792 A1* 5/2010 Muller ..... A43B 7/125 36/83
2011/0185600 A1* 8/2011 Malek ..... A43B 3/26 36/25 R
2011/0252667 A1* 10/2011 Moretti ..... A43B 7/08 36/98
2012/0216428 A1* 8/2012 Marandos ..... A43B 3/0078 36/130
2013/0042502 A1 2/2013 Grisoni
2013/0118032 A1* 5/2013 Raji ..... A43B 1/0027 36/100
2013/0192088 A1* 8/2013 Veldman ..... A43B 7/142 36/44
2014/0090274 A1 4/2014 Arquilla
2015/0208756 A1 7/2015 Patchett
2016/0015128 A1* 1/2016 Cazarez ..... A43B 17/003 36/43

FOREIGN PATENT DOCUMENTS

GB 2514168 A1 11/2014
WO WO2015112471 7/2015

OTHER PUBLICATIONS

Unique Bargains, http://www.walmart.com/ip/Women-Clear-Silicone-Self-Adhesive-Shoes-Insole-Back-Pads-Pair/45586482?wmlspartner=wlpa&selectedSellerId=142&adid=22222222227032831.
Rothco, http://www.walmart.com/ip/Rothco-Memory-Foam-Insoles/38080263?wmlspartner=wlpa&selectedSellerId=71&adid=22222222227026302601&wl0=&wl1=g&wl2=c&wl3=51751091591&wl4=&wl5.
Sloggers, https://www.amazon.com/Sloggers-cut-Half-Sizer-adjusting-Insole/dp/B000KMA9X6.

* cited by examiner

SOLE INSERT WITH MATING ATTACHMENT SYSTEM

BACKGROUND OF THE INVENTION

1) Field of the Invention

The present invention relates to an insert for open-styled footwear, such as flip flop, thong, or similar footwear, that includes a mating attachment system for variably affixing the insole into footwear as well as a kit for using same.

2) Description of Related Art

Various types of shoe insoles are known in the art. For instance, Arquilla '274 (U.S. Pat. Pub. No. 2014/0090274) discloses a shoe insert liner, or no-show sock, configured to detachably adhere to an interior cavity of a shoe. In one embodiment, the shoe insert liner includes a liner having an exterior surface and an adhesive bonded to at least a portion of the exterior surface of the liner. The liner includes a longitudinal portion, opposing first and second lateral portions extending in a first direction from opposite sides of the longitudinal portion, and opposing front and rear portions extending in the first direction from opposite ends of the longitudinal portion. Together, the longitudinal, lateral, front, and rear portions of the liner define an interior cavity and an opening configured to receive a user's foot.

Grisoni '865 (U.S. Pat. Pub. No. 2006/0026865) discloses a removable full length insole for insertion into open style footwear. The insole includes a forefoot portion, a heel portion and a mid-foot portion connecting together the forefoot portion and the heel portion as well as a uniform thickness cushioning layer of a resilient material extending through the forefoot portion, heel portion and mid-foot portion. The insole is a substantially dome shaped pillow extending down from the cushioning layer at the forefoot portion and heel portion.

Greene '074 (U.S. Pat. Pub. No. 20100018074) discloses a partial insole for a fore portion of a foot and a partial insole for a rear portion of a foot. The rear insole supports a calcaneum of a foot and the fore insole supports a foot pad. The partial insole includes a body, pre-fashioned size indication marking, and an adhesive.

GB 2309625 discloses an insole that includes a friction inducing material for introduction between an article of footwear and a user's sock or stocking to reduce slipping of the foot within the footwear when in use. The insole includes an elastomeric base layer capable of being shaped to conform to the configuration of the user's foot, supporting an array of upstanding elements such as loops, bristles, or other elements capable of frictionally engaging the fibers of a user's sock or stocking. In one embodiment the insole comprises a backing layer which is attached on one side to a layer of the material providing the upstanding elements and to the elastomeric base layer on the other side.

Even with the above disclosures, a need still exists for an insole that may be positioned in open style shoes, such as women's sandals or other such footwear that lack side walls and/or heel walls that confine currently available insoles. Further, a need exists for an insole that allows the user to select the locations on the insole and on the surface of the shoe where the foot resides where attachment of the insole to the shoe surface occurs. A need also exists for an insole capable of accommodating the thong of an open toe style shoe. Accordingly, it is an object of the present invention to provide a sole insert with a mating attachment system that allows an insole to be used with open style shoes as well as allows the user to select where the insole adheres to the shoe surface and to configure the insole to accommodate the thong of open toe style shoes.

SUMMARY OF THE INVENTION

In one embodiment, the present disclosure provides an affixation system for an open toe shoe. The system includes an insole with an upper and lower surface, a first variable position anchor having a first upper section with a first contact surface that engages the lower surface of the insole, the first variable position anchor having a first mating surface opposite the first contact surface. There is at least one second variable position anchor having a second upper section with a second contact surface that engages the lower surface of the insole, the second variable position anchor having a second mating surface opposite the second contact surface. The variable position anchors do not cover an entire surface of the lower surface of the insole and engage at any position within an area defined by the lower surface of the insole. Further, the insole has a perforated section. Still further, the perforated section is separable to define a gap in the insole. Still further, the perforated section is removable from the insole to define a slit. Further yet, the insole has a marking system for cutting the insole. Still further yet, there is at least one third variable position anchor that has a third upper section with a third contact surface that engages the lower surface of the insole, the third variable position anchor having a third mating surface opposite the third contact surface. Furthermore, the first variable position anchor, the second variable position anchor, and the third variable position anchor are non-contiguous to one another. Further still, the insole is configured to allow the first, second and third variable position anchors to affix to any portion of the lower surface of the insole. Still further yet, the first, second and third variable position anchors are releasably affixed to the insole.

In another embodiment, a method is provided for affixing an insole within an open toe shoe. The method includes affixing at least one anchor having a first section to any position defined by a lower surface of an insole and affixing the at least one anchor via a second section to a shoe surface wherein the position of the second section on the shoe surface corresponds to the position selected on the lower surface of the insole. Further, a perforated section is defined within the insole. Still further, the perforated section is separable to define a gap in the insole. Further yet, the perforated section may be removed to define a slit within the insole. Still further, the method includes providing a marking system for cutting the insole to fit the open toe shoe. Further still, a second variable position anchor is provided and configured for engaging a surface of a shoe, the second variable position anchor having a mating surface that engages the insole opposite the shoe contact surface. Even further, the first variable position anchor and the second variable position anchor are non-contiguous to one another. Furthermore, the lower surface of the insole is configured to allow the at least one variable position anchor to affix to any portion of the lower surface of the insole. Still further yet, the first variable position anchor and the second variable position anchor are releasably affixed to the insole.

In a still further embodiment, an insole kit for an open toe shoe is provided. The kit includes an insole, a variable position anchor with a first section containing a first mating surface configured to engage the insole, the variable position anchor having a second section containing a second mating surface configured to engage a surface of a shoe, and a perforated section for separating sections of the insole.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1A:
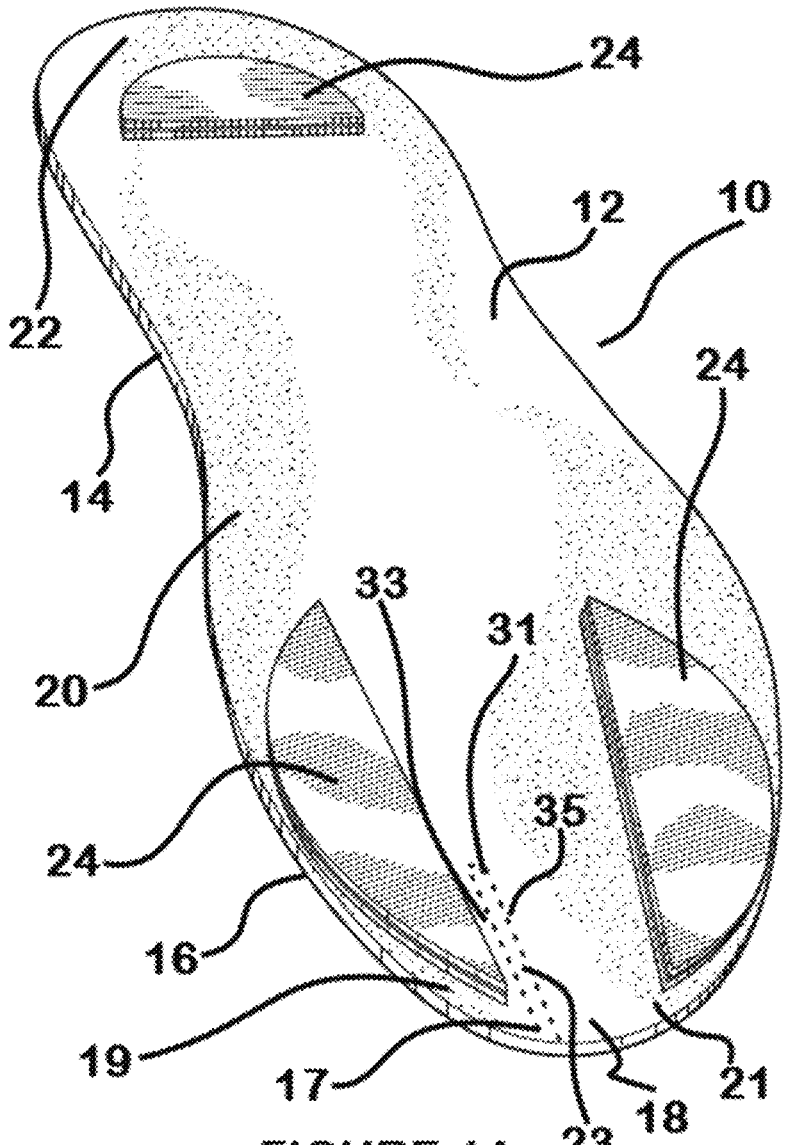
FIG. 1A shows one embodiment of an insole of the current disclosure.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

FIG. 1A shows a bottom view of an insole 10 of the present disclosure. Insole 10 may be formed from various materials such as: thermoplastics, that soften when heated and harden when cooled; polypropylene, a plastic with a low specific gravity and high stiffness that provides a combination of light weight and high strength for manufacturing rigid insoles; suborthoten family, officially known as high-molecular-weight, high-density polyethylene (HMW-HDPE), is a wax-like, inert, flexible, and tough polymer with a high melt strength and deep draw; acrylic such as ROHADUR, POLYDUR, and PLEXIDUR, made from methyl methacrylate polymers; composite carbon fibers, such as combining acrylic plastic with carbon fibers to create a rigid sheet material, such as CARBOPLAST, GRAPHITE, and the TL-SERIES, the "carbons" are good for thin, functional orthotics; cork, which may be combined with rubber binders to create an excellent thermo-formable sheet; leather; polyethylene foams, such as cross-linked polyethylenes (CL-PE) that may include PLASTAZOTE®, PELITE, ALIPLAST®, DERMAPLAST®, XPE, AND NICKELPLAST™, these closed-cell foams are ideal for total-contact, pressure-reducing orthotics; Ethyl-vinyl cetates (EVAs); crepes/neoprenes; and silicones. The above may be used in association, or separate from, foams, gels and laminates. Further, the insole material may be impregnated with antibacterial metallic elements such as titanium, cobalt, zirconium, molybdenum, aluminum, antimony, barium, bismuth, boron, copper, gold, lead, mercury, nickel, silver, thallium, tin, and zinc, in order to impede bacterial growth and reduce odors generated from same.

Insole 10 may be formed to be either unisex in shape or contoured for male and female feet individually. In one embodiment, insole 10 has a bottom surface 12, exterior perimeter 14, upper surface 16, toe section 18, arch section 20, heel section 22. Insole 10 may also have positioners 24. Positioners 24 may be comprised of double-sided tape, male/female engagement mechanisms, hook and loop fasteners such as VELCRO® strips, gecko feet style fasteners, etc., as known to those of skill in the art. Additionally, the insole has perforated section 17 that may allow the user to separate first fore section 19 from second fore section 21 to define a gap between the first and second sections. Separation may be accomplished by separating seam 31, either partially or completely along first seam side 33 or second seam side 35. This allows the user to allow first fore section 19 and second fore section 21 to "float" and/or move independently from another to better accommodate the user's foot profile. Further, perforated section 17 may be removed entirely to form a slit 23 to allow insole 10 to better fit a shoe such a thong sandal or a shoe with split toes or a divider between the toes. This man be accomplished by completely separating seam 31 from insole 10 and removing perforated section 17 from insole 10.

Figure 1B:
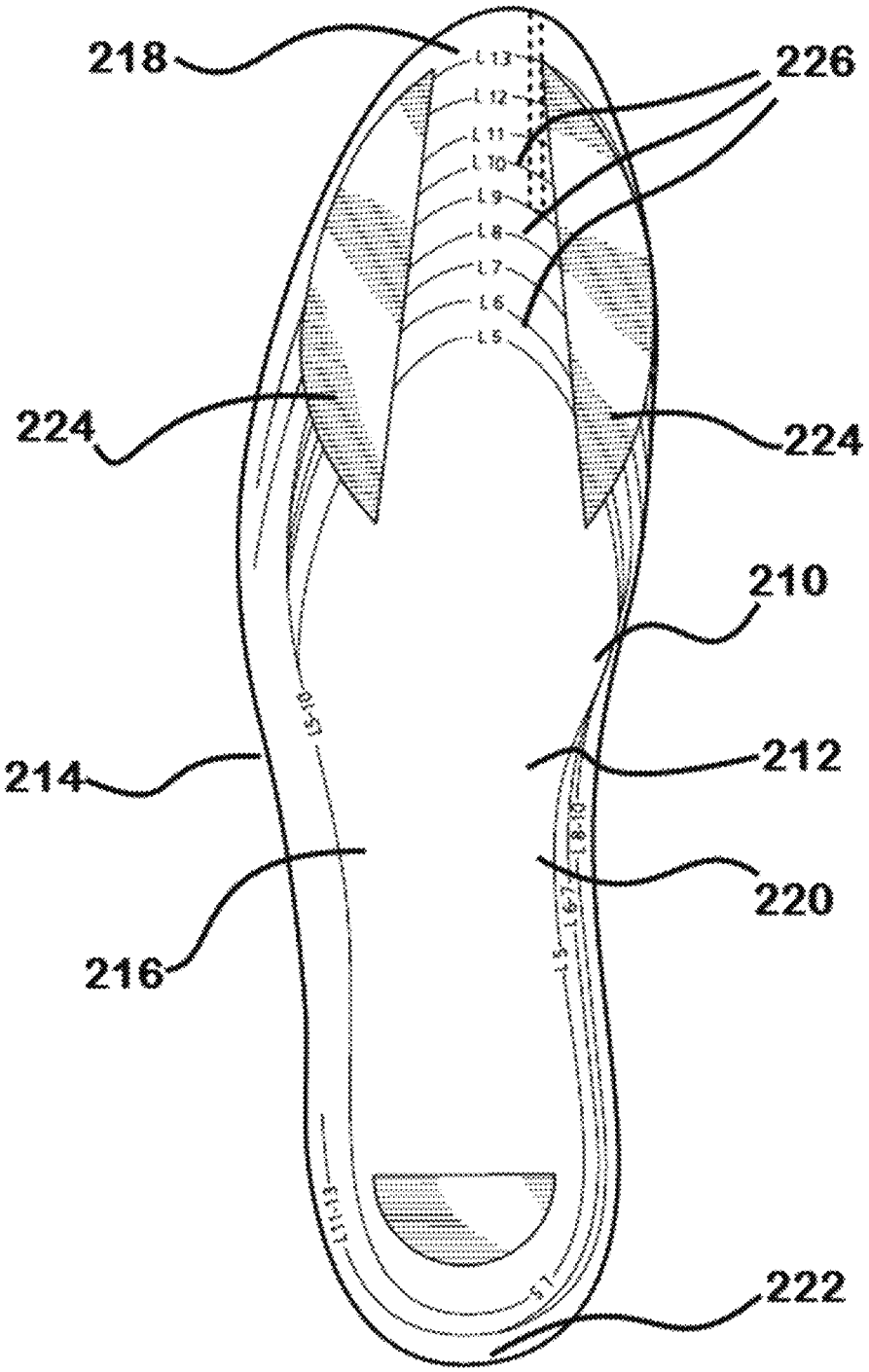
FIG. 1B shows an alternative embodiment of an insole of the current disclosure and FIG. 1C shows the insole with a void defined in the insole.
Figure 1C:
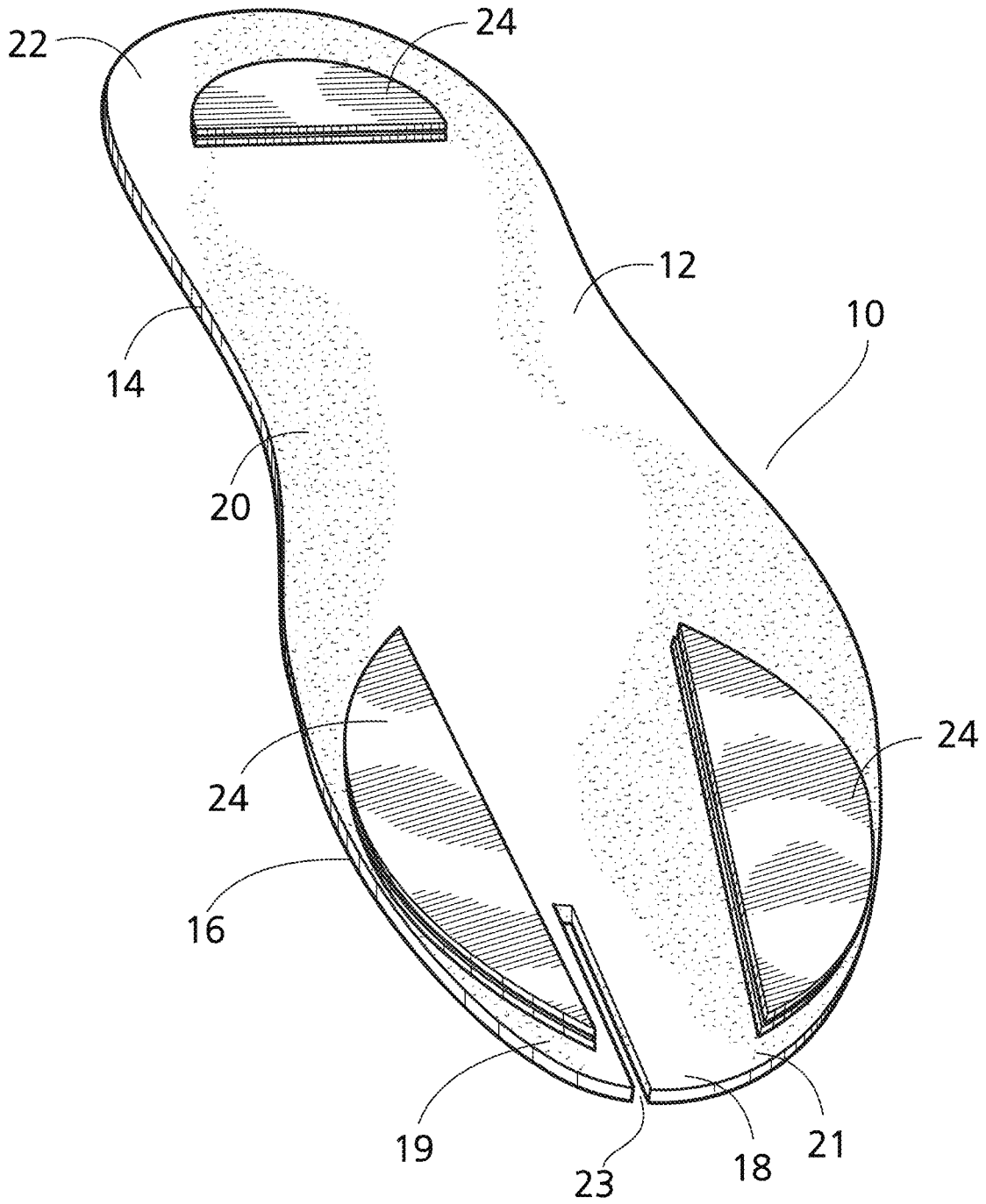

FIG. 1B shows an alternative embodiment of an insole of the current disclosure. Insole 210 may be formed to be either unisex in shape or contoured for male and female feet individually. In one embodiment, insole 210 has a bottom surface 212, exterior perimeter 214, upper surface 216, toe section 218, arch section 220, heel section 222. Insole 210 may also have positioners 224. Positioners 224, in this embodiment, positioners 224 may be comprised of hook and loop fasteners such as VELCRO® strips, gecko feet style fasteners, etc., as known to those of skill in the art. An opposing hook and loop strip, not shown, would be secured to the foot contacting surface of the shoe to secure insole 210 to the shoe. Further, indicia 226 may be used to help a user cut the insole to a specific size.

Figure 2:
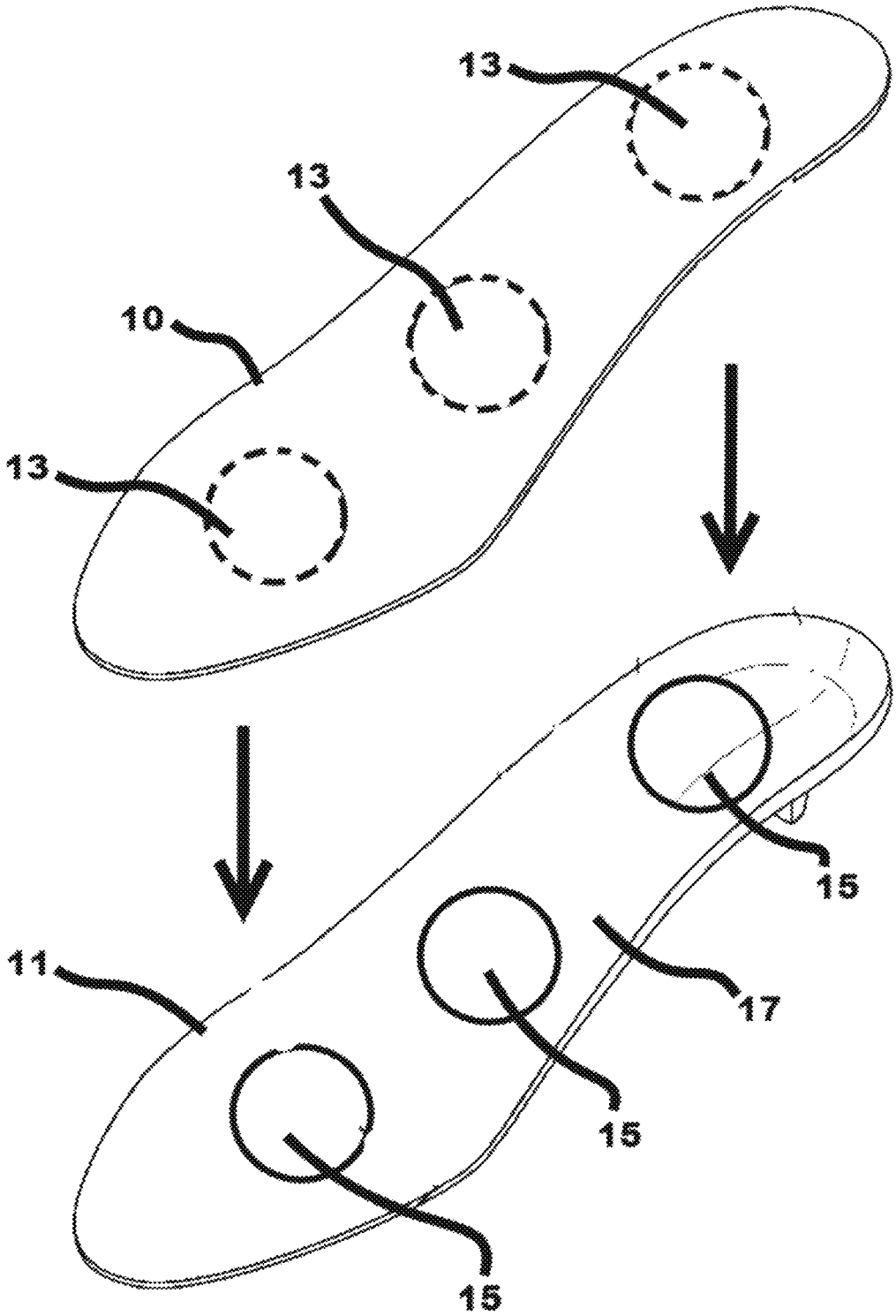
FIG. 2 shows an alternative embodiment of an insole of the current disclosure.

FIG. 2 shows one embodiment of insole 10 and an open toe shoe 11. Insole 10 may contain first positioner component(s) 13 while second positioner component(s) 15 are located on the foot contacting surface 17 of shoe 11. As described herein, first positioner component(s) 13 and second positioner component 15 may be designed to engage/attach/affix or otherwise contact one another to secure insole 10 within shoe 11. As long as first positioner component 13 and second positioner component 15 are positioned opposite one another such their respective mating surfaces engage, first positioner component 13 and second positioner component 15 may be positioned anywhere on the respective surfaces of insole 10 and shoe 11. While FIG. 2 shows three first and second positioner components, more or less positioner components are considered within the scope of this disclosure.

Figure 3:
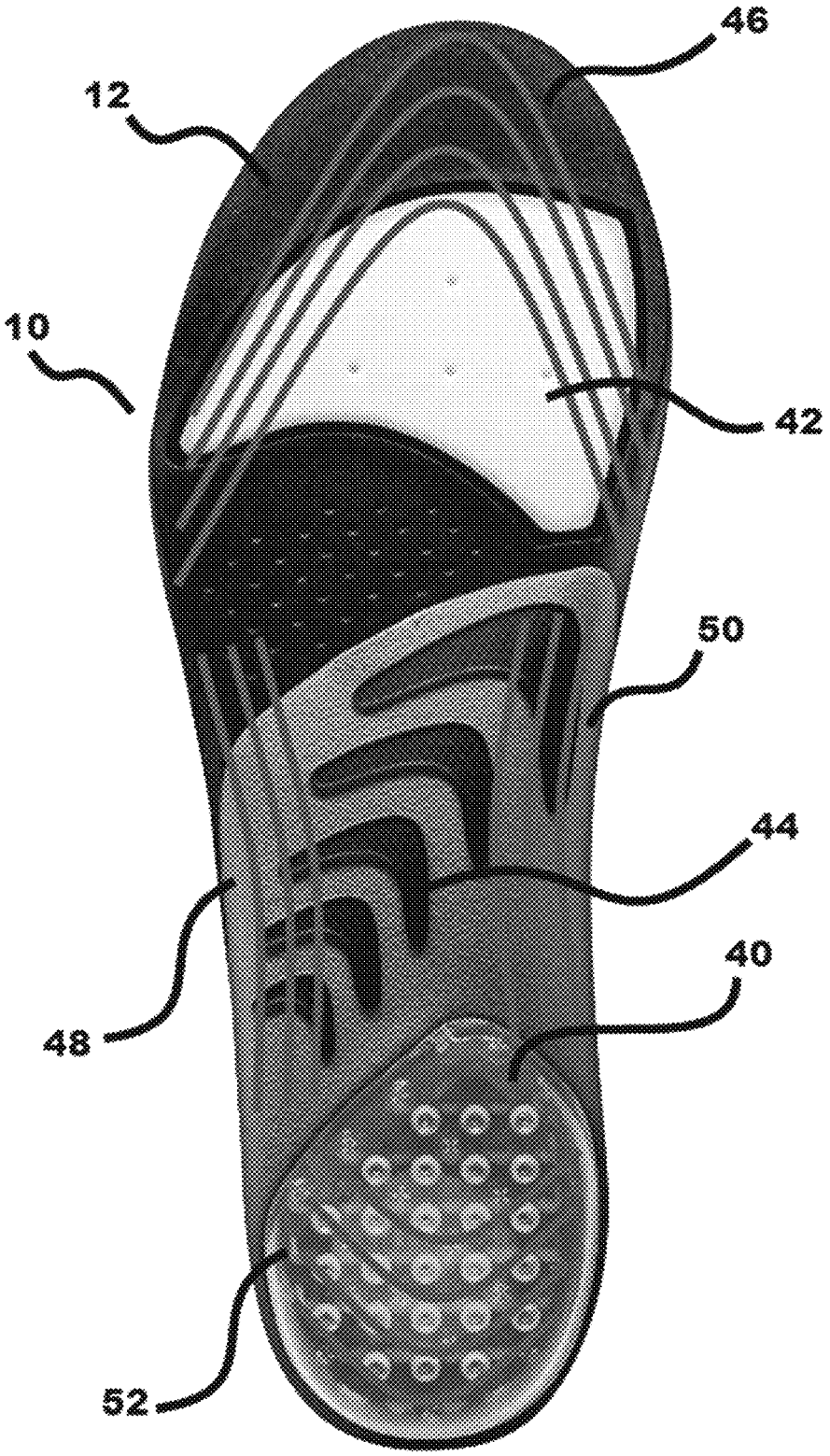
FIG. 3 shows a lower surface of an insole of the current disclosure.

With respect to FIG. 3, bottom surface 12 of insole 10 may include supporting structures 40 alone or in combination with comfort structures 42. Supporting structures 40, while shown in FIG. 2 as columns, may be waves, spirals, elliptical structures, or other shapes as known to those of skill in the art. Supporting structures 40 may be hollow, gel filled, liquid filled or otherwise structured as known to those of skill in the art in order to provide support to a user's foot when in contact with insole 10. Comfort structures 42 may be comprised of foam, gel, liquid filled, or formed from the materials listed supra. Comfort structures 42 are designed to provide a yielding surface for the user's foot and in a preferred embodiment may possess shape memory in order to adjust to the user's foot and retain the adjusted shape. Insole 10 may also include gripping structures 44 for helping maintain insole 10 within an open toe structure. Further, supporting structures 40 and comfort structures 42 may be located in a single location or spread over bottom surface 12 of insole 10. While shown as triangular shaped, gripping structures 44 may be any shaped that assists insole 10 with staying positioned within a shoe. Insole 10 may also include size indicia such as toe indicia 46, first side indicia 48, second side indicia 50, and heel indicia 52. These indicia may be used by a user to trim insole 10 in order to have it fit within an open toe style shoe and to adjust insole 10 to the particular shape of the user's foot. When trimmed, indicia 46, 48, 50, and 52 may indicate cutting through support structures 40, comfort structures 42 and gripping structures 50 in order to better size insole 10 to the shoe and user's foot.

Figure 4A:
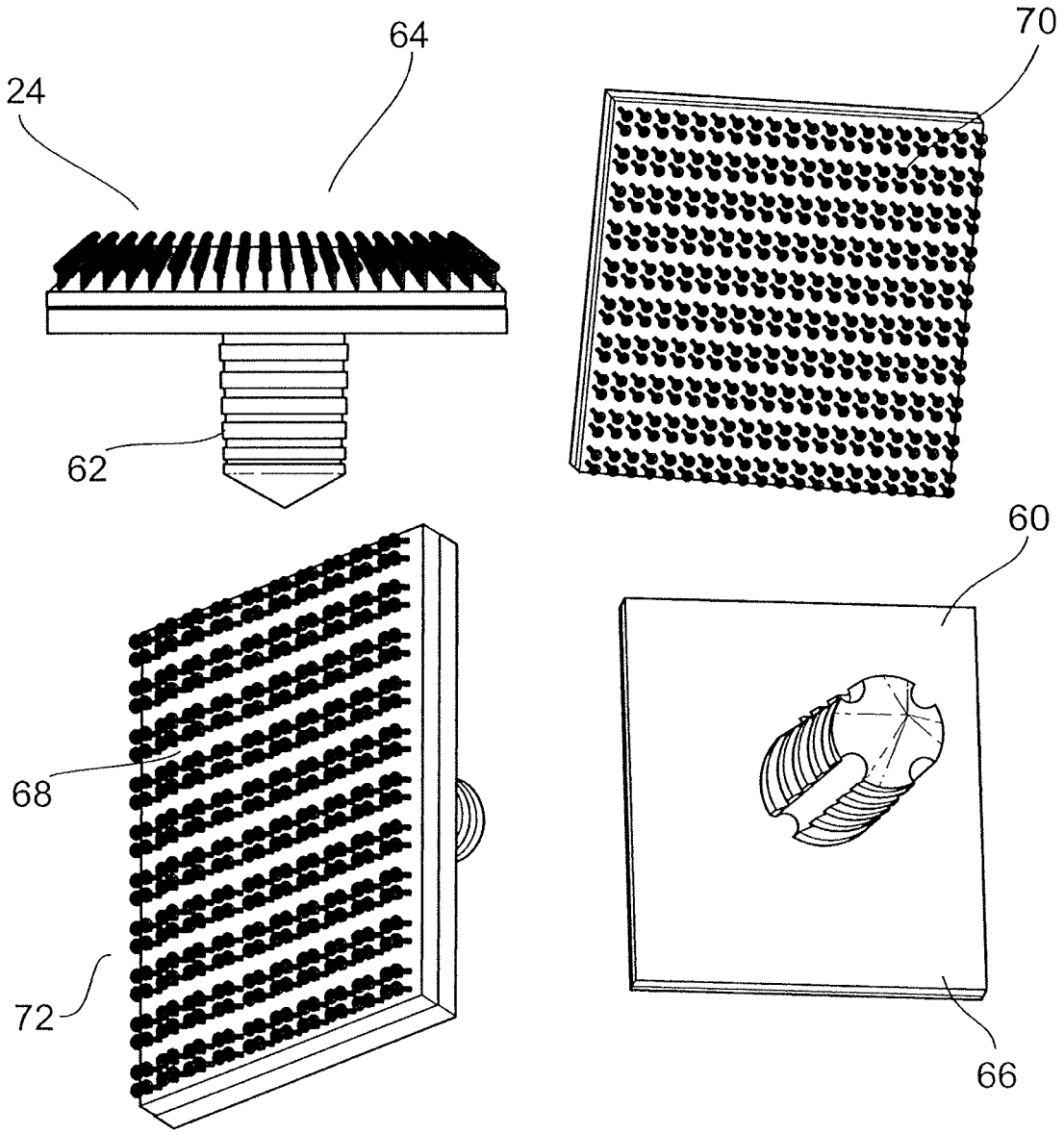
FIG. 4A shows one embodiment of an anchor of the current system.

FIG. 4A shows one embodiment of the structure of positioners 24. In this embodiment, positioners 24 may comprise a platform 60 with an anchor 62 to secure positioners 24 to insole 10. A mating pair of anchors 64 and 66, may be used to variably secure positioners 24 on bottom surface 12 of insole 10, as well to secure the an opposing positioner 24 to the shoe surface, not shown, to which insole 10 will engage. This allows the users to determine exactly where positioners 24 will reside on insole 10 and the surface of the shoe to which insole 10 will attach. In this embodiment, anchors 62 may be inserted into insole 10 and the shoe surface in an opposing fashion such that first mating surface 68 and second mating surface 70 may engage and affix to one another when insole 10 is positioned in the shoe by the user. This improvement is currently unavailable in the art and allows the user to specifically place positioners 24 for maximum comfort to the user. While mating surfaces 68 and 70 are shown as hook and loop fasteners 72 in this embodiment, this disclosure is not so limited and adhesives, tapes, mechanical fasteners, etc., may be placed on platform 60 in order to form structures capable of engaging one another to form mating surfaces 68 and 70.

Figure 4B:
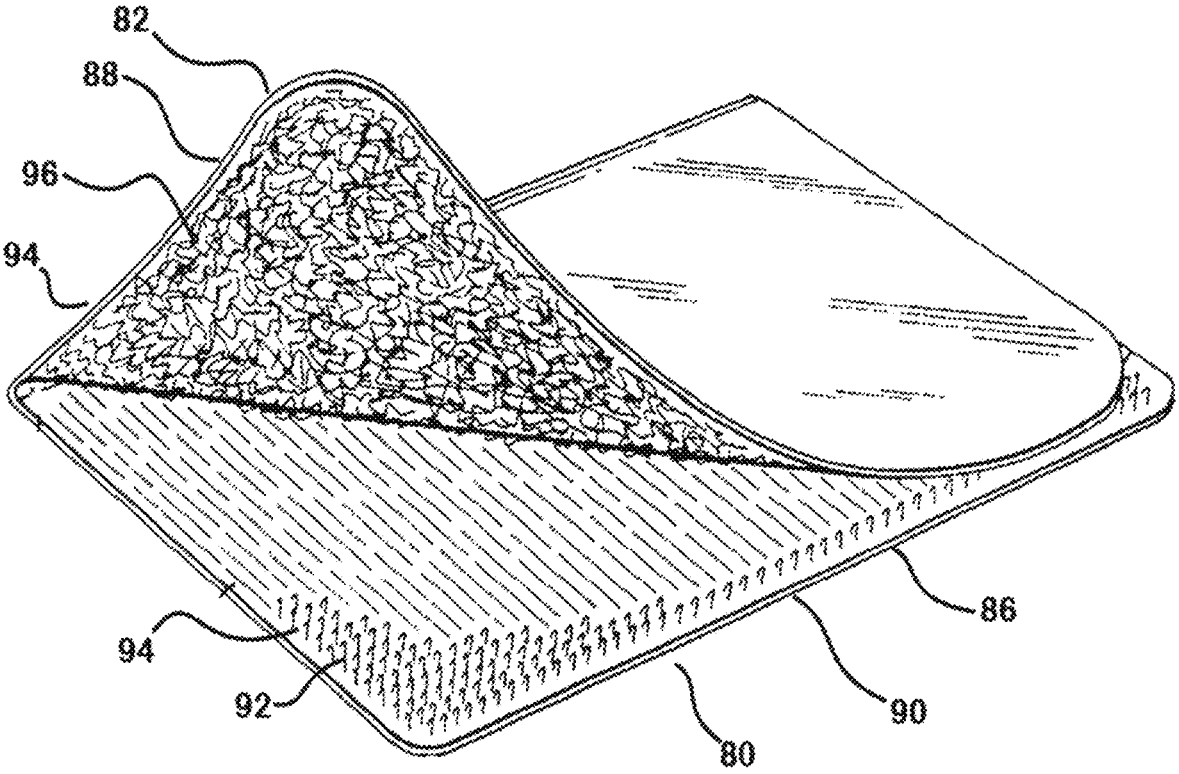
FIG. 4B shows an alternative embodiment of an anchor of the current system.

FIG. 4B shows an alternative embodiment of positioner 80 wherein positioner 80 is comprised of a strip 82 of hook and loop fastener 84. Adhesive surfaces 86 and 88 may be used to secure first back surface 90, opposite mating surface 92, and second back surface 94, opposite mating surface 96, to bottom surface 12 of insole 10 and the surface of the shoe on which insole 10 will lay. First back surface 90 and second back surface 92 may be positioned on insole 10 or the shoe surface upon which insole 10 will rest. While strip 82 may be provided to the user previously shaped in any manner known to those of skill in the art, in a further embodiment, the user may cut strip 82 into any desired shape or configuration in order to customize the fit of insole 10 into the shoe.

Figure 4C:
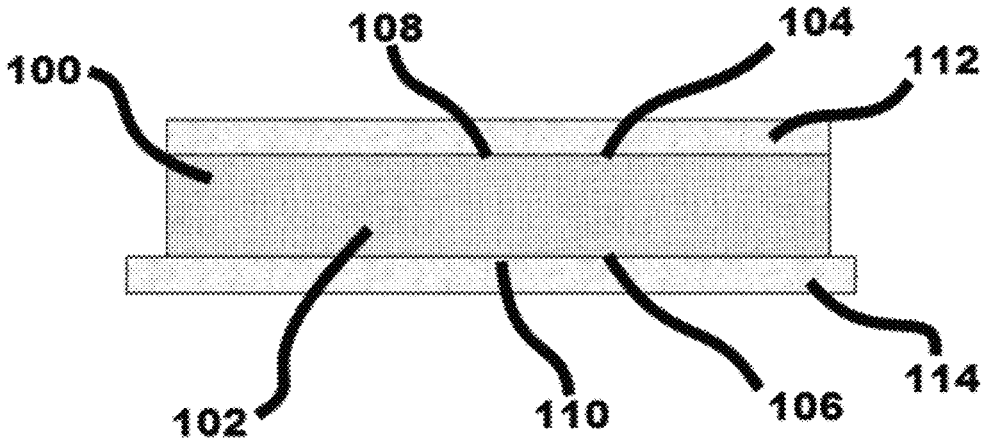
FIG. 4C shows a further alternative embodiment of an anchor of the current disclosure.

FIG. 4C shows a further alternative embodiment of a positioner of the current disclosure. In this embodiment, positioner 100 may include a double-sided adhesive structure 102. Structure 102 includes a first adhesive surface 104 and a second adhesive surface 106. In one embodiment, first adhesive surface 104 includes a permanent adhesive 108 while second adhesive surface 106 includes a releasable or temporary adhesive 110. In this embodiment, first adhesive surface 104 may be permanently affixed to the bottom of insole 10, not shown, while second adhesive surface 106 may be releasably affixed to the shoe surface in order to allow for multiple removals and insertions of insole 10 into and out of a shoe. First protective film 112 may be placed over first adhesive surface 104 and second protective film 114 may be placed over second adhesive surface 106 to protect the adhesives from prematurely adhering to surfaces or articles prior to placing positioner 100 on insole 10.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An affixation system for an open toe shoe comprising:
an insole with an upper and lower surface;
a first variable position anchor having a first upper section with a first contact surface that engages the lower surface of the insole, the first variable position anchor having a first mating surface opposite the first contact surface;
at least one second variable position anchor having a second upper section with a second contact surface that engages the lower surface of the insole, the second variable position anchor having a second mating surface opposite the second contact surface; and
wherein the variable position anchors cover a portion surface of the lower surface of the insole and engage at any portion selected on the lower surface of the insole; and
wherein the insole has a perforated section and the perforated section is removable from the insole to define a slit in a toe section of the insole wherein the slit remains defined in the toe section of the insole after removal of the perforated section wherein the slit is configured to allow the insole to better fit the open toe shoe or a thong sandal.

2. The affixation system of claim 1, wherein the insole has a marking system comprising arcuate indicia and lines marked on the insole for cutting the insole.

3. The affixation system of claim 1, wherein at least one third variable position anchor has a third upper section with a third contact surface that engages the lower surface of the insole, the third variable position anchor having a third mating surface opposite the third contact surface.

4. The affixation system of claim 2, wherein the first variable position anchor, the second variable position anchor, and a third variable position anchor are non-contiguous to one another.

5. The affixation system of claim 3, wherein the lower surface of the insole is configured to allow the first, second and third variable position anchors to affix to any portion of the lower surface of the insole.

6. The affixation system of claim 2, wherein the first, second and a third variable position anchors are releasably affixed to the insole.

7. A method for affixing an insole within an open toe shoe comprising:
affixing at least one variable position anchor having a first section to any portion defined by a lower surface of an insole; and
affixing the at least one variable position anchor to a second section of the open toe shoe wherein the position of the second section on the shoe surface corresponds to the position selected on the lower surface of the insole;
affixing the at least one variable position anchor at any portion selected on the lower surface of the insole; and
defining a perforated section within the insole, wherein removing the perforated section defines a slit within a toe section of the insole, wherein the slit remains defined in the toe section of the insole after removal of the perforated section wherein the slit is configured to allow the insole to better fit the open toe shoe or a thong sandal.

8. The method of claim 7, further comprising including a marking system comprising arcuate indicia and lines marked on the insole for cutting the insole to fit the open toe shoe.

9. The method claim 7, further comprising a second variable position anchor configured for engaging a surface of a shoe, the second variable position anchor having a mating surface that engages the insole opposite the shoe contact surface.

10. The method of claim 9, wherein the first variable position anchor and the second variable position anchor are non-contiguous to one another.

11. The method claim 7, further comprising releasably affixing the first variable position anchor and the second variable position anchor to the insole.

12. An insole kit for an open toe shoe comprising:
an insole;
a variable position anchor with a first section containing a first mating surface configured to engage the insole;
the variable position anchor having a second section containing a second mating surface configured to engage a surface of the open toe shoe;
wherein the variable position anchor cover a portion surface of the lower surface of the insole and engages at any portion selected on the lower surface of the insole; and
a perforated section for separating sections of the insole wherein removing the perforated section defines a slit within a toe section of the insole, wherein the slit remains defined in the toe section of the insole after removal of the perforated section wherein the slit is configured to allow the insole to better fit the open toe shoe or a thong sandal.

13. The affixation system of claim 1 wherein formation of the slit in the toe section of the insole forms a first fore section and second fore section that move independently of one another.

14. The method of claim 7 wherein forming the slit in the toe section of the insole forms a first fore section and a section fore section that move independently of one another.

15. The insole kit of claim 12 wherein forming the slit in the toe section of the insole forms a first fore section and a section fore section that move independently of one another.

* * * * *